US005215605A

United States Patent [19]

Fraser

[11] Patent Number: 5,215,605

[45] Date of Patent: Jun. 1, 1993

[54] NIOBIUM-ALUMINUM-TITANIUM INTERMETALLIC COMPOUNDS

[75] Inventor: Hamish L. Fraser, Columbus, Ohio

[73] Assignee: The Ohio State University Research Foundation, Columbus, Ohio

[21] Appl. No.: 735,536

[22] Filed: Jul. 23, 1991

[51] Int. Cl.[5] ..... C22C 14/00; C22C 29/00

[52] U.S. Cl. ..... 148/422; 420/417; 428/627; 428/662

[58] Field of Search ..... 148/422; 420/417; 428/627, 662

[56] References Cited

U.S. PATENT DOCUMENTS 4,896,815 1/1990 Rosenthal ..... 228/120

5,019,334 5/1991 Jackson ..... 420/417

OTHER PUBLICATIONS

Kaltenbach et al, Z. Metallkde, 80 (1989) 535.

Prokoshkin et al, "Alloys of Niobium" Acad. Science, USSR, 1985, pp. 136–137.

*Primary Examiner*—Upendra Roy

*Attorney, Agent, or Firm*—Frank H. Foster

[57] ABSTRACT

Intermetallic compounds or alloys comprising niobium with and from 10 to 28 atomic percent titanium and from 14 to 17.5 atomic percent aluminum characterized by very high temperature melting points, high compressive strength at room temperature, higher room temperature compressive strength after annealing, machineable with conventional tooling, a B2 crystal structure in the as-cast condition, a two-phase microstructure in the annealed condition consisting of a B2 matrix and a second phase with the A15 crystal structure, an expected low value for coefficient of thermal expansion and susceptible to fabrication into single crystals.

11 Claims, No Drawings

NIOBIUM-ALUMINUM-TITANIUM INTERMETALLIC COMPOUNDS

This invention was made with government support under contract No. N00014-90-J-1440, awarded by office Onaral Research. The government may have certain rights in this invention.

Technical Field

The present invention consists of a new group of intermetallic compounds or alloys of niobium 14 to 17.5 atomic percent (a/o) aluminum and 10 to 28 atomic percent (a/o) titanium added in place of niobium.

BACKGROUND ART

There is presently a tremendous effort, both domestically and on an international scale, to develop high temperature materials which are intermetallic compounds for certain commercial elevated temperature applications.

There are two problems with intermetallic compounds particularly those with high melting points, namely limited room temperature ductility and poor high temperature strength. In terms of the first limitation, this causes the material to be of limited potential application since in most such applications some degree of ductility is required and necessary. In the case of advanced materials for propulsion systems, such as jet engine turbine blades, the room temperature ductility required can be quite small. In these cases, application of a given brittle material requires the use of very elaborate and thus expensive machinery.

High temperature-high strength intermetallic compounds also have potential use as a matrix material in intermetallic-ceramic composites. However, the coefficient of expansion of conventional intermetallic alloys are sufficiently different from ceramics that the stresses between these materials that develop upon heating can be sufficiently detrimental to the properties of the composite, and deter such application.

BRIEF DISCLOSURE OF INVENTION

The present invention involving the Nb-Al-Ti alloys or intermetallic compounds represents a breakthrough because, for the first time, a set of compounds has been developed which exhibits very high melting points (required for elevated temperature strength), high room temperature strengths and in addition may be machined using conventional tools and techniques (i.e. the use of a lathe and milling machine with standard high speed-steel tooling). This ability to machine using conventional means is quite unique, not being offered by other competitive compounds such as those based on nickel or titanium aluminides.

Another advantage associated with these compounds includes the attendant advantage concerning their use as matrix materials in intermetallic composites (IMCs). One of the problems with attempts so far to produce IMCs involves the poor match between the coefficient of thermal expansion (CTE) of the matrix and reinforcing phases: for example, most ceramic reinforcements have CTEs in the range of $5\text{-}10.10^{-6}C^{-1}$ compared to the values for most known intermetallic compounds which are typically in the range of $12\text{-}20.10^{-6}C^{-1}$. The CTEs of the compositions of the present intention will be in the range of $8\text{-}11.10^{-6}C^{-1}$ which are closer to, and thus are more compatible with, those of the ceramic compositions.

The alloys of the present invent on have been found to possess particularly desirable high temperature melting points, high compression strength at room temperature in the as-cast condition, higher strength in the heat treated or annealed condition, machinable using conventional apparatus and techniques, a crystal structure in the as-cast condition that is particularly amenable to forming, relatively low values for the coefficients of thermal expansion (making them ideal candidates as matrix materials in composites that include ceramics) and a microstructure compatible for conversion into single crystal materials.

It is accordingly an object of the present invention to provide an intermetallic compound or alloy comprising niobium 14 a/o to 17.5 a/o aluminum and 10 to 28 a/o titanium.

It is also an object of the present invention to provide an intermetallic compound that is machinable at room temperature but exhibits high temperature strength properties.

It is a further object of the present invention to provide niobium-aluminum-titanium intermetallic compounds or alloys with one or more of the characteristic materials with high temperature melting points; high value compressive strengths at room temperature as-cast; increased room temperature strength as annealed; machinable with conventional high speed tool steel apparatus and techniques; a crystal structure amenable to deformation; a low coefficient of thermal expansion; and capable of quenching to a single crystal structure.

DETAILED DESCRIPTION

It has been discovered that intermetallic compounds or alloys of niobium, 14–17.5 a/o aluminum and 10–28 a/o titanium exhibit unexpected mechanical and physical properties that are superior to such compounds and alloys falling outside of these ranges or other such intermetallic compositions.

These compositions have been found to have very high melting points in the range of 1800° C.–2200° C. Such high temperature melting points make these composites particularly useful as refractory materials in propulsion systems such as jet engine parts subject to high temperatures.

Testing has shown these materials to exhibit a very high value of compressive strength at room temperature in the as-cast condition. For example, compression tests conducted on samples of Nb-15Al-10Ti a/o in the as-cast condition showed a value of 800MPa (approximately 114,000 psi). When these samples were annealed at 1100° C. for 50 hours, the room temperature compressive strength increased to 1154MPa (approximately 164,000 psi).

It was found that samples of this material could be machined using conventional machines and normal high speed steel tooling. This shows extensive ductility of the individual grains.

Crystallographic examination of the Nb-15Al-10Ti material showed the B2 crystal structure in the as-cast condition, in which deformation is achieved by motions of dislocations with Burgers vectors(b) of the type $b=<111>$. Microexamination shows a two-phase crystal structure in the annealed condition, consisting of a matrix of B2 and a second phase with the A15 crystal structure.

Binary alloys of Nb and Ti, Nb and Al and similar compositions have been shown to have a relatively low value for the coefficients of thermal expansion (CTE) and it is expected that the present compounds will have CTE's in the range of $8\text{-}11.10^{-6}C^{-1}$ which is significant since ceramic materials have CTEs in the range of $5\text{-}10.10^{-6}C^{-1}$ which overlap in part and are close enough to make these materials ideal for use as matrix materials in intermetallic matrix composites with ceramic materials.

Micrographic examination has shown the grain size of the instant material as solidified from the molten state are typically 1-5mm which clearly shows the material lends itself to conversion to single crystal materials. This materially enhances its uses since such structures (single crystals) are used in advanced gas turbine engines.

The materials of the present invention are made by conventional crucible melting under a protective atmosphere and are cast in a water-cooled hearth. The tests described above were conducted using conventional testing equipment well-known in the metals industry.

For the purposes of this specification, the term intermetallic compounds or alloys means combinations of metals with limited solubility in one another, but which form molecular combinations to provide crystalline metallic materials. The intermetallic compounds of the present invention is basically $Nb_3Al$. The titanium addition is essentially a substitution for a part of the niobium so that in atomic percent the aluminum content remains nearly the same (i.e. about 15 a/o) although it may range from about 14 a/o to 17.5 a/o (about 4.77 to 7.56% by weight). The niobium content may range from about 89.18 to 60.24 (% by wt.) depending on the titanium (and aluminum) content which may range from 10 to 28 a/o (about 6.05 to 32.2 wt. %).

While certain preferred embodiments of the present invention have been disclosed in detail, it is to be understood that various modifications may be adopted without departing from the spirit of the invention or scope of the following claims.

I claim:

1. An intermetallic compound comprising niobium, from 14 a/o to 17.5 a/o aluminum, and from 10 a/o to 28 a/o titanium.

2. The compound of claim 1 in the as-cast condition.

3. The compound of claim 1 in the annealed condition.

4. The compound of claim 1 having at least one of the characteristics:

a) a melting point of from 1800° C.-2000° C.;
b) high compressive strength of about 800MPa;
c) a higher compressive strength of about 1154MPa following annealing at 1100° C. for 50 hours;
d) machinable with conventional high speed steel tooling;
e) a B2 crystal structure in the as-cast condition;
f) a coefficient of thermal expansion in the range of
g) having a two-phase crystal structure in the annealed condition, consisting of a matrix of B2 and a second phase with the A15 crystal structure.

5. The compound of claim 1 characterized by a melting point of from 1800° C.-2000° C.

6. The compound of claim 1 characterized by high compressive strength of about 800MPa.

7. The compound of claim characterized by a higher compressive strength of about 1154Ma having been annealed at 1100° C. for 50 hours.

8. The compound of claim 1 characterized by being machinable with conventional high speed tooling.

9. The compound of claim 1 characterized by a B2 crystal structure in the as-cast condition.

10. An intermetallic compound consisting essentially of niobium, 15 a/o aluminum and from 10 a/o to 28 a/o titanium.

11. A composite comprising an intermetallic compound and a ceramic material wherein the intermetallic compound consists of niobium and 14 a/o to 17.5 a/o aluminum, and 10 a/o to 28 a/o titanium, said intermetallic compound having a coefficient of expansion of $8\text{-}11\times10^{-6}C^{-1}$, and wherein said ceramic material has a coefficient of expansion of $5\text{-}10\times10^{-6}C^{-1}$.

* * * * *

UNITED STATES PATENT AND TRADEMARK OFFICE

CERTIFICATE OF CORRECTION

PATENT NO. : 5,215,605

DATED : June 1, 1993

INVENTOR(S) : Hamish L. Fraser

It is certified that error appears in the above-identified patent and that said Letters Patent is hereby corrected as shown below:

Column 1, line 6, delete "of-"; line 7, delete "fice Onaral" and insert therefore --the Office of Naval--; line 67 for "intention" read --invention--. Column 2, line 3, for "invent on" read --invention--. Claim 4 f), after "in the range of" insert --8-11.$10^{-6}C^{-1}$; and--. Claim 7, line 1, after "claim" insert --1--; line 2, for "Ma" read --MPa--.

Signed and Sealed this

Twenty-first Day of December, 1993

Bruce Lehman

*Attest:*

BRUCE LEHMAN

*Attesting Officer*

*Commissioner of Patents and Trademarks*